US011698084B2

(12) United States Patent
Schmieder et al.

(10) Patent No.: US 11,698,084 B2
(45) Date of Patent: Jul. 11, 2023

(54) METHOD FOR OPERATING A PUMP

(71) Applicant: E.G.O. Elektro-Geraetebau GmbH, Oberderdingen (DE)

(72) Inventors: Manuel Schmieder, Oberderdingen (DE); Volker Block, Bretten (DE); Hannes Kuemmerle, Oberderdingen (DE); Kay Schmidt, Oberderdingen (DE); Michael Tafferner, Malsch (DE); Henry Zipplies, Eppingen (DE)

(73) Assignee: E.G.O. ELEKTRO-GERAETEBAU GMBH, Oberderdingen (DE)

( * ) Notice: Subject to any disclaimer, the term of this patent is extended or adjusted under 35 U.S.C. 154(b) by 216 days.

(21) Appl. No.: 17/198,709

(22) Filed: Mar. 11, 2021

(65) Prior Publication Data

US 2021/0332830 A1 Oct. 28, 2021

(30) Foreign Application Priority Data

Apr. 24, 2020 (EP) ..... 20171318

(51) Int. Cl.

| | |
|---|---|
| ***F04D 29/58*** | (2006.01) |
| ***F04D 29/42*** | (2006.01) |
| ***A47L 15/42*** | (2006.01) |
| ***A47L 15/00*** | (2006.01) |

(52) U.S. Cl.

CPC ..... *F04D 29/588* (2013.01); *A47L 15/4225* (2013.01); *A47L 15/4285* (2013.01);

(Continued)

(58) Field of Classification Search

CPC .... F04D 29/588; F04D 29/584; F04D 29/426; F04D 19/00; F04D 27/006;

(Continued)

(56) References Cited

U.S. PATENT DOCUMENTS 3,117,523 A * 1/1964 Jacobs ..... A47L 15/4225 415/218.1
4,070,204 A * 1/1978 Hardy ..... A47L 15/4287 134/36

(Continued)

FOREIGN PATENT DOCUMENTS

DE 102014224593 A1 6/2016
EP 2772563 A1 9/2014

*Primary Examiner* — Courtney D Heinle
*Assistant Examiner* — Ryan C Clark
(74) *Attorney, Agent, or Firm* — Alston & Bird LLP

(57) ABSTRACT

A pump of a dishwasher has an integrated heating element, a pump chamber with an inlet and an outlet, a pump rotor inside the pump chamber and a drive motor, wherein the heating element and a temperature sensor are provided on a wall of the pump chamber. For measuring a calcification of the pump chamber it is filled with water and then the pump rotor rotates for mixing the water in the pump chamber without transporting water out of the pump chamber. The temperature of the water in the pump chamber is measured with the temperature sensor as a starting temperature, and then the heating element is activated to heat the water in the pump chamber while the temperature of the water in the pump chamber is measured. Then the heating element is deactivated and the maximum temperature of the water during the heating duration or directly afterwards is determined. A temperature relation between the maximum temperature and the starting temperature of the water is calculated. These steps are executed in the pump at the very beginning of an operation of the new dishwasher after its installation for determining an initial temperature relation. These steps are automatically executed again at a later stage for determining a later temperature relation to determine the heating efficiency of the pump by comparing the later temperature relation to the initial temperature relation.

23 Claims, 2 Drawing Sheets

(52) U.S. Cl.
CPC ..... *A47L 15/4287* (2013.01); *F04D 29/426* (2013.01); *A47L 15/0057* (2013.01); *A47L 2401/12* (2013.01); *A47L 2501/05* (2013.01); *A47L 2501/06* (2013.01)

(58) Field of Classification Search
CPC ..... A47L 15/4225; A47L 15/4285; A47L 15/4287; A47L 15/0057; A47L 2501/05; A47L 2501/06
See application file for complete search history.

(56) References Cited

U.S. PATENT DOCUMENTS 5,560,060 A * 10/1996 Dausch ..... A47L 15/0044 68/12.22
6,001,190 A * 12/1999 El-Shoubary ..... A47L 15/4202 134/25.1
9,297,553 B2 * 3/2016 Vallejo Noriega ... F24H 9/2028
9,470,242 B2 10/2016 Albert et al.
9,771,950 B2 * 9/2017 Friedrichs ..... F04D 29/586
9,816,527 B2 * 11/2017 Koebrich ..... D06F 39/085
10,260,505 B2 * 4/2019 Block ..... F04D 29/426
10,302,098 B2 * 5/2019 Li ..... F04D 29/588
2001/0042560 A1 * 11/2001 Steck ..... A47L 15/4225 134/107
2010/0043829 A1 * 2/2010 Kim ..... A47L 15/0049 134/18
2017/0086257 A1 3/2017 Muehlnikel et al.
2018/0256003 A1 * 9/2018 Park ..... A47L 15/4291
2019/0010656 A1 * 1/2019 Kim ..... F22B 37/47
2019/0128284 A1 * 5/2019 Hoffmann ..... D06F 39/085
2019/0162204 A1 * 5/2019 Zoppas ..... D06F 39/04
2019/0269294 A1 9/2019 Wecker et al.
2019/0335540 A1 10/2019 Höfer et al.
2020/0033277 A1 * 1/2020 Törnquist ..... G01N 25/72
2020/0113406 A1 4/2020 Törnquist et al.

* cited by examiner

METHOD FOR OPERATING A PUMP

CROSS-REFERENCE TO RELATED APPLICATIONS

This application claims priority to European Application No. 20171318.7, filed Apr. 24, 2020, the contents of which are hereby incorporated herein in its entirety by reference.

FIELD OF APPLICATION AND PRIOR ART

The invention relates to a method for operating a pump with an integrated heating element as well as to a pump that is adapted to perform this method together with a control means.

Pumps for pumping water and heating this water at the same time are known in the art, for example from U.S. Pat. No. 9,470,242 B. They are provided with a pump chamber, wherein a heating element is provided on a circumferential wall of the pump chamber. This heating element allows for very efficient heating of the water during the pumping action. One problem that is also addressed in EP 2772563 A1 is that due to high temperatures at the inside of the wall of the pumping chamber at the location of the heating element, calcification may occur in intensified manner. Such a calcification is regarded as negative because it has an impact on the heating efficiency of the heating element in that the heating energy is not going into the water so well as if no calcification would be present.

From US 2017/086257 A1 a method is known to detect heavy calcification on a heating element with the aid of various temperature sensors, mainly temperature sensors covering a large surface of the heating element. A drawback of this method is, however, that it only works when already dangerously high temperatures can be measured.

Problem and Solution

An object of the invention is to provide a method for operating a pump with an integrated heating element, in particular for determining the heating efficiency of the pump or of the heating element, respectively, preferably also by measuring temperatures.

This problem is solved by a method with the features of claim 1. Advantageous and preferred embodiments of the invention are included in the further claims and are described hereinafter in further detail. Some of these features are described only in connection with the method or only in connection with a pump for performing this method. However, independently of this, they shall apply to the method as well as to the pump itself in independent manner. The wording of the claims is made to the content of the description by explicit reference.

The pump for the invention comprises at least a pump chamber with an inlet into the pump chamber and an outlet out of the pump chamber as well as a pump rotor inside the pump chamber, preferably an impeller. A drive motor for the pump rotor is provided in usual manner. Furthermore, a heating element is provided on at least a part of a wall of the pump chamber, preferably on a circumferential lateral wall of the pump chamber which runs around a longitudinal axis of the pump chamber and around a rotational axis of the pump rotor. The heating element is preferably of conventional manner in the art, more preferably a thick film heating element. Furthermore, a temperature sensor is provided for sensing the temperature of water in the pump chamber, preferably arranged on a wall of the pump chamber, in particular on the same wall as the heating element. The temperature sensor may have a distance to the heating element of 2 mm up to 1 cm or even 3 cm. The temperature sensor may advantageously be provided at a location of the wall of the pump chamber where, even if only a small amount of water is provided in the pump chamber, this water is in contact with the inside of the wall of the pump chamber directly opposite the temperature sensor mounted on the outside of the wall.

In the method of the invention, the following steps are provided. In a step A water is provided in the pump chamber. This preferably may be a predefined amount of water, for example such that the pump chamber is completely filled, and even potentially some more water can be brought in which is partly transported or pumped out of the pump chamber. In a step B the pump rotor is rotating or the pump is operated, respectively, for mixing or moving the water around in the pump chamber. This is made in a way that water is not transported out of the pump chamber in substantial manner, in particular not as a permanent through flow of the pump. This means that the pump may generate a specific water pressure at the outlet of the pump chamber, which comes to a kind of equilibrium in a fluid pipe connected to the outlet such that, for example at least after 1 sec to 10 sec, no more water is pumped out of the pump chamber. The water being present inside the pump chamber then stays in the pump chamber, although it is mixed or rotated by the pump rotor.

In a following step C the temperature of the water in the pump chamber is measured with the temperature sensor. This temperature is a starting temperature and may be stored by a control device connected to the pump and to the temperature sensor.

In a step D following step C the heating element is activated to heat the water in the pump chamber after the starting temperature has been measured. Preferably, the heating element is activated for a predefined heating duration, which may be between 1 sec and 60 sec, preferably between 20 sec and 30 sec. By mixing or rotating the water in the pump chamber, it is provided that the water is heated evenly such that a temperature of the water is in direct relation to the heating energy from the heating element dissipated into the water under a given heating efficiency. In a following step E the temperature of the water in the pump chamber is measured with the temperature sensor again. This preferably takes place when the heating element is activated, more preferably permanently or continuously as long as the heating element is activated and advantageously even for some more time.

In a following step F the heating element is deactivated, preferably after the predefined heating duration has elapsed. The maximum temperature of the water during the heating duration or shortly afterwards the heating duration is determined, preferably again in the control device mentioned before that is measuring the temperature sensor. In most cases this maximum temperature of the water in the pump chamber will be reached at the end of the heating duration or a few seconds afterwards, for example 2 sec to 5 sec afterwards or even somewhat longer, for example a maximum 10 sec, in the case of a heating element with more thermal capacity, for example due to thicker materials.

In the next step G a temperature relation between the maximum temperature of the water and the starting temperature of the water is calculated. This temperature relation may be of various kinds, for example as a quotient. In preferred manner, the temperature relation is a difference such that the starting temperature of the water is subtracted from the maximum temperature of the water which regularly exceeds the first. The steps A to G are executed in the pump at a beginning of its operation or at the latest during one of the first 50, preferably the first 15, operating cycles of the pump after the device with the pump has been installed and connected to the mains, for example as a placing into operation. This means that the method is performed for the first time when the pump is rather new and no calcification may be present to have an initial temperature relation. This initial temperature relation is stored, preferably in the control device mentioned before. It corresponds to the behavior or the heating efficiency of the pump and its heating element in a state where no calcification may be present, so the heating efficiency should be at a maximum.

The steps A to G are executed again at a later stage, which should preferably happen automatically, for determining a later temperature relation to determine the heating efficiency or a calcification, respectively, of the pump or of the heating element, respectively. Such a later stage may be after a certain number of operating cycles or operating duration of the heated pump or its heating element, more specifically. For example, the later stage for executing the steps A to G may be after 5 to 100, preferably after 10 to 50, operating cycles of the pump, wherein such an operating cycle may correspond to a whole cleaning process in a dishwasher. Alternatively, the steps may be executed after 30 min up to 20 h of summed up heating operation of the heating element. Such a determination with an operating duration of the heating element is regarded as the better way. The heating efficiency or a calcification of the pump or of the heating element is then determined by comparing the later temperature relation to the initial temperature relation. Depending on the nature of the temperature relation, a change will occur in such a direction that a calcification on the pump chamber wall will start and increase, thereby expectedly reducing the heating efficiency. In the case mentioned before where the temperature relation is a temperature difference, the later temperature difference will be less than the initial temperature difference due to the fact that in case of a given or predefined heating duration less heating energy is brought into the water in the pump chamber due to growing calcification. This means that the maximum temperature that can be reached during the heating duration is lower at the later stage than at the initial start of using the pump.

The heating efficiency derived from this method as explained before may not necessarily be quantified exactly. It is sufficient that it may be qualified such that it can be monitored in some manner and, if the heating efficiency drops significantly or substantially, certain steps are effected. They are described hereinafter.

In one embodiment of the invention, the monitoring of the heating efficiency is used to take countermeasures against any substantial calcification in the pump chamber that has been detected. It may be that in case that the later temperature difference mentioned before as a specific embodiment of a temperature relation is less than 90% of the initial temperature difference, preferably less than 70% of the initial temperature difference, a de-calcification should be started. This may either be made by generating an optical and/or acoustical signal prompting a user of the pump or of a household device with this pump to start a de-calcification process of the pump. This may take place in known manner by giving a de-calcification medium into the water cycle of the pump, for example in the form of a tablet or liquid means. Alternatively, an automatic de-calcification process of the pump or of the household device, respectively, is started such that a de-calcification medium is automatically brought into the water cycle of the pump. It may be provided that, directly after finishing the de-calcification process, the method with the steps A to G is performed to check whether the de-calcification has been successful in that now the heating efficiency corresponds again to the initial heating efficiency such that the actual temperature difference and the initial temperature difference are about the same.

If the temperature relation is not implemented as a temperature difference explained before, but for example as a quotient of the maximum temperature divided by the initial temperature, this quotient will also become smaller with a growing calcification of the pump chamber wall. It may be provided that also in this case if a temperature quotient is less than 90% or less than 70% of the initial temperature quotient, the same steps as described before for initiating a de-calcification are started.

As has been described before, although the pump rotor should rotate to mix the water in the pump chamber such that the heating energy is distributed homogeneously, no water should be pumped through the pump chamber such that a predefined amount of water is heated. This can either be made by measuring a through flow through the pump, if such is provided, wherein this through flow should of course be zero during activation of the heating element. Then the drive motor is regulated to avoid a through flow. Alternatively, as the details of the integration of the pump into a household device are not always the same, and also measuring a through flow through the pump may be difficult, a fixed rotational speed may be predefined for the pump. Such a fixed rotational speed is preferably less than 500 rpm, more preferably from 10 rpm to 300 rpm. It can be a specific fraction of the nominal rotational speed of the pump in regular operation, for example 3% to 10%.

A further advantage of the invention is that by determining the initial temperature relation for the pump individually, individual characteristics of the pump are already taken into account automatically for a later use. This preferably includes a predefined fixed rotational speed of the pump rotor, which even more preferably results in a constant predefined amount of water that is brought into the pump chamber or provided in the pump chamber when operating the heating element with this predefined fixed rotational speed for later use. So this predefined fixed rotational speed and the constant predefined amount of water are stored as information.

In a further preferred embodiment of the invention, the temperature relations may be determined more exactly or in a better way if the steps A to G are repeated consecutively at least two times or three times to find a median temperature relation from each of the determined temperature relations. This reduces the risk that unexpected peculiarities may lead to an incorrect or exceptional temperature relation. It is advantageously provided that after each cycle of performing the steps A to G, some time may be allowed to pass for the pump and the heating element, respectively, to cool down again after heating operation. This waiting time may be reduced by pumping some fresh and cold water through the pump. It may even be provided that at least the later determination of the heating efficiency and the temperature relation, respectively, is integrated into a process being performed by the household device anyway during its regular operation, for example in a dishwasher during a rinsing process. Alternatively, also the determination of the temperature relations may be made not as an integral part of a regular process of the household device, but separately and apart from this, for example after having finished such a regular process.

A predefined heating duration may be chosen between 10 sec and 60 sec, preferably between 20 sec and 30 sec or 40 sec. This predefined heating duration should advantageously be chosen such that the temperature difference between the activation of the heating element and its deactivation should be about 20° C. and more, in particular up to 50° C. or 60° C. It is preferably avoided that the water in the pump chamber reaches a boiling temperature of more than 90° C. or 95° C., respectively. The reason is that with such relatively high temperatures, an effect of bringing the heating energy of the heating element into the water is slowed down enormously such that there is no linear correlation between heating energy and temperature, and, in particular, not any specific correlation anymore.

It can be provided that an operating voltage of the heating element is monitored and a correction factor is adapted to variations of the operating voltage, wherein this correction factor is taken into account when determining the temperature relation. This provides for the advantageous option to become independent from variations of the operating voltage between temperature measurements. This may provide to adapt to variations of a few Volts of the operating voltage as well as operating the pump and its heating element with either 230 V in Europe or 120 V in the US.

A drive voltage in a drive circuit for the drive motor may correspond to the operating voltage of the heating element such that it is possible to only measure the drive voltage which might be easier for a control unit. Preferably, the drive motor as well as the heating element are operated with the mains voltage that a household device being provided with the pump is connected to, in particular 230 V or 120 V as mentioned before.

In a further preferred embodiment of the invention, the heating element may have a PTC characteristic or may be a PTC heating element, wherein its resistance behavior has a PTC effect. This may provide for enhanced safety of the heating element in case serious problems with overheating may occur. The temperature sensor on the other hand may preferably be an NTC temperature sensor having an NTC effect of its resistance behavior. This allows for a precise temperature measurement.

The construction of the pump may be such that the pump has an axial inlet into the pump chamber such that it is a radial pump. An outlet out of the pump chamber is to the side, potentially parallel to a radial direction, so that the pump rotor is an impeller with an axial flow of water into it and a radial output of the water. The water can be circulating in the pump chamber for two to five times before it leaves the pump chamber through the outlet in normal operation, whereas in the invention no water should leave the pump chamber during measuring the temperature.

A household device provided with the pump is also provided with a control unit to control the heating element and the drive motor as well as to measure the temperature with the temperature sensor. It also includes a timer function to monitor the predefined heating duration as well as to determine when the steps A to G shall be performed and for how many times consecutively to determine a heating efficiency of the pump and of its heating element. The control unit should have a microcontroller and a storage, preferably integrated into the microcontroller.

These and further features may be gathered from the claims and also from the description and the drawings, with the individual features being capable of being implemented in each case by themselves or severally in the form of sub-combinations in an embodiment of the invention and in other fields and being capable of constituting advantageous and independently patentable versions for which protection is claimed here. The subdivision of the application into individual sections and intermediate headings does not restrict the general validity of the statements made under these.

BRIEF DESCRIPTION OF THE DRAWINGS

Exemplary embodiments of the invention are schematically illustrated in the drawings and will be explained in more detail below. In the drawings.

DETAILED DESCRIPTION OF THE EMBODIMENTS

Figure 1:
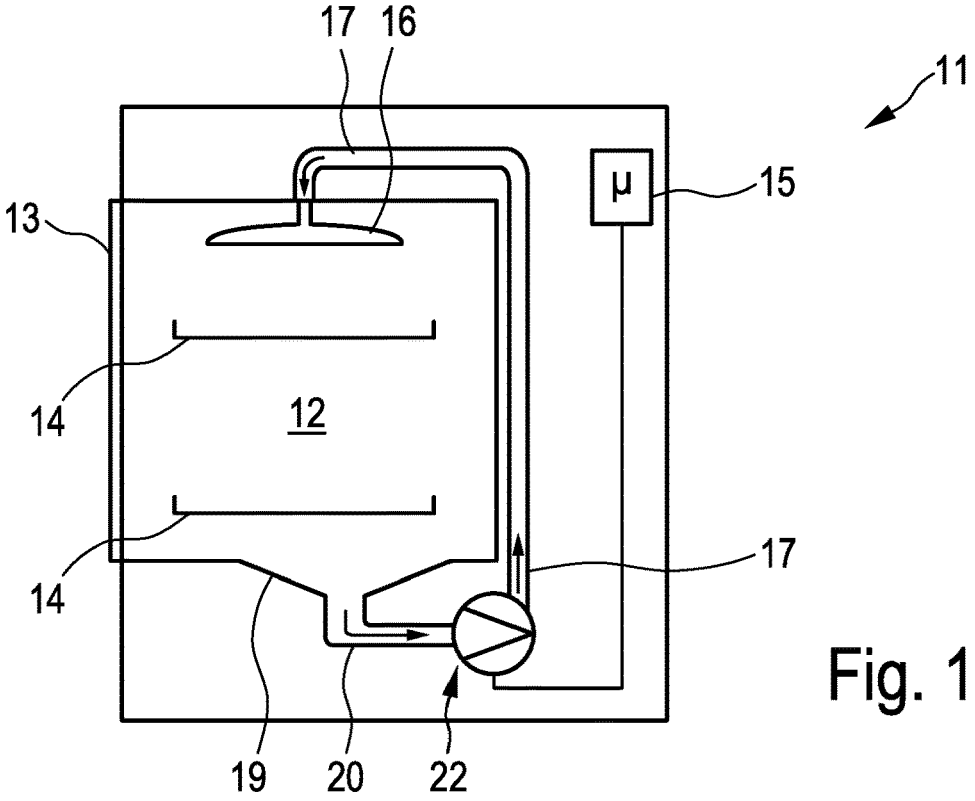
FIG. 1 shows a schematic view of a dishwasher in which the method according to the invention is implemented by a control unit.

In FIG. 1 a dishwasher for performing the method according to the invention is shown in schematic manner. The dishwasher 11 is basically as is known in the art with a washing chamber 12 which can be accessed via a door 13. In the washing chamber 12 two baskets 14 for example are arranged one above the other for receiving dishes to be cleaned. Above the upper basket 14 a schematic jet arm 16 is provided which rotates and which has a number of small jet openings on the underside directed towards the baskets 14. Water is pumped to the jet arm 16 via a delivery pipe 17. Preferably more than only one jet arm is provided in the washing chamber 12, which for easier understanding of FIG. 1 has been left out.

On the bottom of the washing chamber 12 a so-called sump 19 is provided from which a drain pipe 20 leads water to a pump 22 according to the invention. Pump 22 is shown in more detail in FIG. 2 and described with reference to FIG. 2.

A control unit 15 of the dishwasher 11 is provided which is connected to the pump 22 as is shown in FIG. 1. This connection is meant to be schematic and of course, in practice, is rather different. It is clear from FIG. 1 that pump 22, which is a so-called motor heat pump to pump water while heating it, can circulate water from the washing chamber 12 via the sump 19 and the drain pipe 20 back into the washing chamber via the delivery pipe 17 and the jet arm 16.

Figure 2:
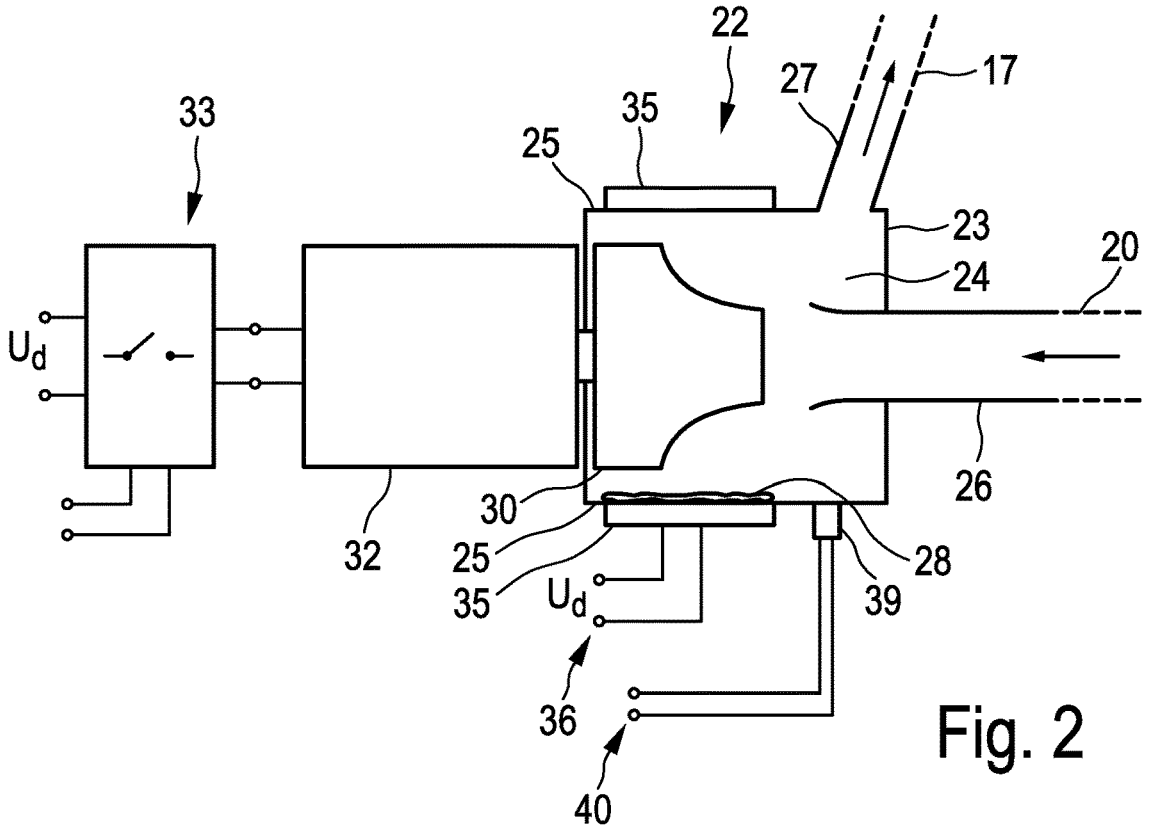
FIG. 2 shows a schematic view of a pump of the dishwasher of FIG. 1.

FIG. 2 shows a schematic view of the pump 22 in more detail. It is explicitly referred to U.S. Pat. No. 9,470,242 B for further details. Pump 22 has a pump housing 23 in which a pump chamber 24 is provided, preferably round-circular. The pump chamber 24 has an outer lateral pump chamber wall 25. An inlet 26, that is connected to the drain pipe 20, leads into the pump housing 23 and into the pump chamber 24. An outlet 27 connected to the delivery pipe 17 leads out of the pump chamber 24.

Inside the pump chamber 24, a pump rotor 30 is provided which rotates when driven by the drive motor 32. The rotating pump rotor 30, in practice rotating with about 3,000 to 6,000 rpm, sucks in water through the inlet 26 with axial direction. This water is then ejected in radial direction so that it circulates for several times inside the pump chamber 24 around the pump rotor 30 until it leaves the pump chamber 24 via the outlet 27. This is known very well in the art.

The drive motor 32 is powered or provided with electrical power, respectively, by the drive circuit 33. The drive circuit 33 is connected to a drive voltage Ud, preferably the mains voltage. The drive circuit 33 is connected to or controlled by the control unit 15. This allows for controlling the power and, in particular, the speed of the drive motor 32 and, consequently, of the pump rotor 30. It is also possible and preferred to measure the drive voltage Ud in the drive circuit 33 to provide this information to the control unit 15.

On the outside of the pump chamber wall 25 a heating element 35 is provided. Such is known in the art and can be taken, for example, from U.S. Pat. No. 9,470,242 B. The heating element 35 may be provided as a thick film heating element, alternatively as an electrical heating element in different realization. The heating element 35 is provided with a heating element connection 36. This is connected to a switch circuit which is not shown here to operate the heating element 35 with the drive voltage Ud. In a preferred embodiment of the invention, the heating element 35 is operated in a kind of pulsed mode or in a pulse width modulation mode, which means that the heating element 35 is either fully powered with the drive voltage Ud or is switched off.

The heating element 35 has PTC properties of its resistance. This means that the resistance of the heating element rises if the temperature rises. This leads to a temperature of the heating element 35 above the intended operating temperature, which via the PTC effect of its resistance leads to a higher resistance and a smaller heating power output. This smaller or reduced heating power output leads to the maximum temperature of the water after the heating duration being lower than the maximum temperature if the heat generated by the heating element 35 could be better transported into the water in the pump chamber 25 without calcification on the inside of pump chamber wall 25.

In other words, the strong calcification of the inside of the pump chamber wall 25 has a negative impact onto the heat transfer from the heating element 35 into the water through the pump chamber wall 25 so that it is lower. This leads to a higher temperature of the heating element 35 which due to the PTC effect results in the resistance becoming higher. This higher resistance again leads in view of a fixed operating voltage to the heating power output becoming smaller. This together with the reduced heat transfer into the water leads to the maximum temperature of the water being reduced after the same time or heating duration, respectively. Such a calcification 28 is depicted in FIG. 2, although the thickness is grossly exaggerated here. In practice, such a calcification may have a thickness of between 100 μm and 1 mm or even more than 1 mm.

On the outside of the pump chamber wall 25, preferably with a slight distance to the heating element 35, a temperature sensor 39 is provided. Temperature sensor 39 is provided in good heat-conducting manner to the pump chamber wall 25 to exactly measure its temperature. Basically, the temperature sensor 39 is provided to measure the temperature of the water inside the pump chamber 24 and on the inside of the pump chamber wall 25. The temperature sensor 39 is an NTC temperature sensor. It has sensor connections 40, which preferably are connected to the control unit 15. Further temperature sensors like the temperature sensor 39 could be provided on the pump chamber 24 or the pump chamber wall 25, respectively.

In the method according to the invention the basic operation for measuring a temperature is to operate the pump rotor 30 with low power and low speed, for example with 300 rpm. This could be about 5% to 10% of the maximum speed. Such a rather low speed of the pump rotor 30 provides for some water to be sucked into the pump chamber 24 via the drain pipe 20 and the inlet 26. The pump rotor 30 tries to kind of pump the water or transport it via the outlet 27 and the delivery pipe 17. Due to the low rotational speed of the pump rotor 30, the water cannot be transported much higher than the outlet 27, for example only for 3 cm to 5 cm in the vertical direction. Then an equilibrium is established, which by itself is important. This equilibrium serves to have some water inside the pump chamber 24, preferably filling it mostly or totally, wherein this amount of water is not changing and does neither flow through the outlet 27 out of the pump chamber 24 nor through the inlet 26. The water inside the pump chamber 24 is also mixed very well by the rotating pump rotor 30.

The temperature sensor 39 measures the temperature of the water circulating inside the pump chamber 24, in particular of the cold water with a temperature of 24° C. This information is provided to the control unit 15. If this information is present in the control unit 15, the heating element 35 is activated, preferably with its maximum power due to its preferred operation via PWM. Such a heating process can be taken from FIG. 3, wherein the fat line shows a temperature T over time t. At 56 sec after starting, the heating element 35 is activated with its full power. The water inside the pump chamber 24 is being mixed and can, in consequence, absorb the heat generated by the heating element 35 in an optimum way. The temperature sensor 39 can sense the rising temperature according to the fat line in FIG. 3. After 26 sec of heating time, the heating element 35 is switched off again. Some seconds after that, the measured temperature has reached its maximum at 61° C. After this maximum, the temperature declines again.

As the starting temperature of the cold water inside the pump chamber 24 before the heating element 35 has been activated has been measured to amount to 24° C., a temperature difference is 37° C. or 37 K, respectively. This temperature difference is a very simple implementation of a temperature relation mentioned before. The value of 37 K as an initial temperature difference is stored in the control unit 15. This measuring process can be repeated for one or two times to find a median initial temperature difference that does not depend on chance.

Figure 3:
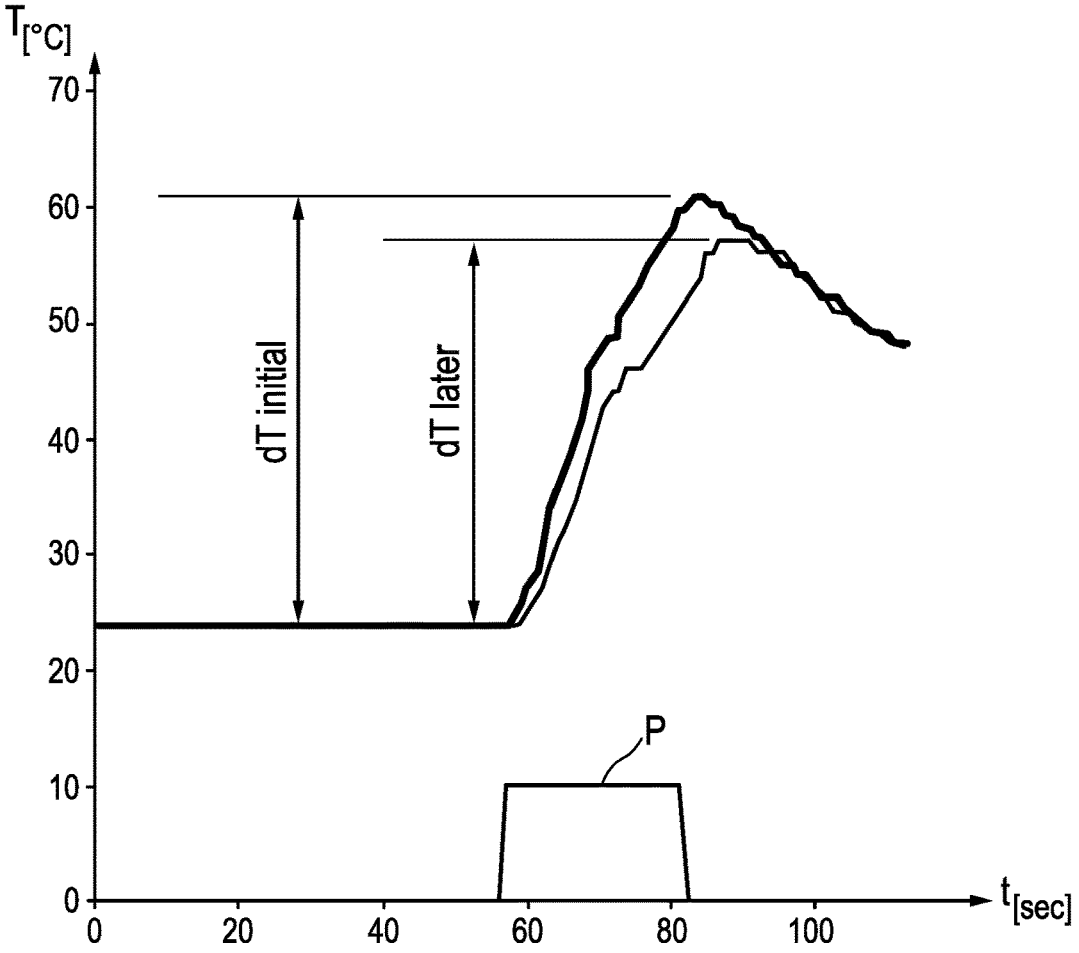
FIG. 3 shows a diagram for the temperature over time, which temperature a temperature sensor on the pump of FIG. 2 has measured

If now after several operating cycles of the pump 11 some calcification 28 has formed on the inside of the pump chamber wall 25, and if then the temperature measurement is started again, a course of the temperature T over time is shown in the thin line in FIG. 3. Due to the effect described before, not only less heating energy can be brought into the water in pump chamber 24 through the pump chamber wall 25 via the heating element 35, but the calcification leads to the effect that the heating element 35 itself heats up more than in the case described before without calcification 28, which again leads to a reduced heating power of the heating element 35 due to its PTC behaviour. This leads to the maximum power reached with this heating element 35 or pump 22, respectively, being reduced and that after 26 sec of heating time a maximum temperature of only 57° C. is reached. Such a later temperature difference after several operating cycles of the pump 11 consequently amounts to only 33° C. Furthermore, this maximum temperature is reached even later than in the initial case described before due to the reduced heat conducting behaviour resulting from the increased calcification 28.

So the initial temperature difference has been 37° C., and the later temperature difference is 33° C. If now the difference between these two differences, for example, has reached 5° C., this is a clear sign for the control unit 15 that a calcification 28 is present in the pump chamber 24 and, consequently, the heating efficiency of the pump 22 has been degraded too much. If a temperature difference is too big, a signal can be output to the user to start a de-calcification process, for example by adding some substances into the dishwasher 11 to initiate de-calcification as is known in the art.

Even if in view of FIG. 3 it should not be waited to reach the maximum temperature only after the heating element 35 has been deactivated again, the temperatures at the end of the heating duration could be measured right away and compared to each other.

In a further variation of the embodiment it can be provided that not only one temperature sensor 39 is provided at the pump chamber 24, but two or even three temperature sensors. Such a measurement informing about the difference can thus be made for only one of them or for all of them.

As has been described before, it is preferred to measure the drive voltage Ud at the drive circuit 33, which is also the operating voltage of the heating element 35. This information can be used to correct values of this drive voltage Ud supplying the heating element 35 if it is reduced slightly when turning on the heating element 35. This is shown in FIG. 4.

As has been described before, such a measurement can be repeated several times, for example for three times, to find a median value. Then the water that has been heated up to the temperature according to FIG. 3 is removed from the pump chamber 24 by operating the pump 22 with nominal power. Fresh and cold water can then be sucked in as has been described before and its temperature can be measured again to have a correct starting point for the temperature difference.

Figure 4:
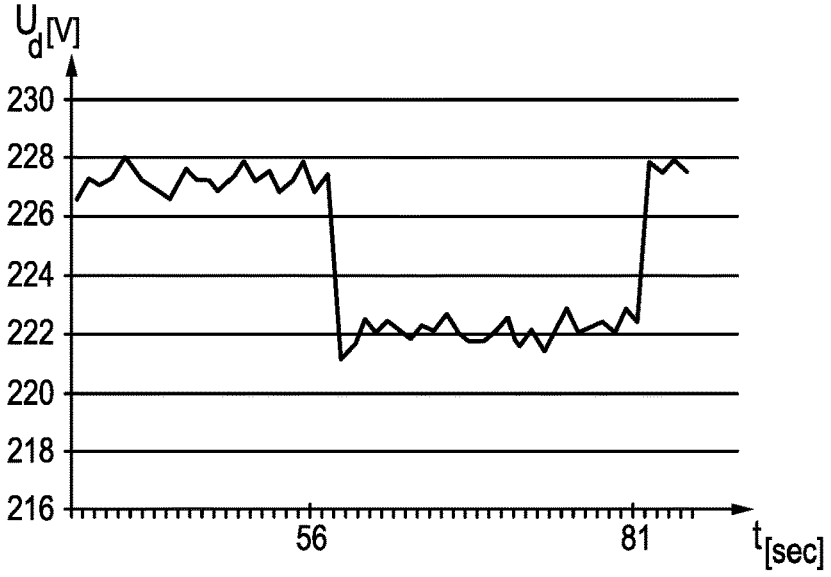
FIG. 4 shows the drive voltage of the drive motor with a temporary cutback due to the activation of the heating element.

FIG. 4 shows the drive voltage of the drive motor 32 with a temporary cutback due to the activation of the heating element 35 in the same time frame as in FIG. 3. This cutback is about 5 V. This cutback can be eliminated mathematically as has been described before. As the drive voltage Ud is also used to power the heating element 35, the heating power is affected also by this cutback. But the control unit 15 can see the drive voltage Ud due to its connection to the drive circuit, so a compensation for this is easy for the control unit 15. The control unit 15 and the drive circuit 33 could be realized in one housing or in one common component even.

The invention claimed is:

1. A method for operating a pump with an integrated heating element, wherein said pump comprises: a pump chamber with an inlet into said pump chamber and with an outlet out of said pump chamber and with a wall, a pump rotor inside said pump chamber, a drive motor for said pump rotor, a heating element being provided on at least a part of said wall of said pump chamber, and a temperature sensor for sensing a temperature of water in said pump chamber, the method comprising the steps of:

A providing water in said pump chamber,

B rotating said pump rotor for mixing said water in said pump chamber without transporting water out of said pump chamber, C measuring a temperature of said water in said pump chamber with said temperature sensor as a starting temperature, D activating said heating element to heat said water in said pump chamber after measuring said temperature of said water, E measuring said temperature of said water in said pump chamber with said temperature sensor, F deactivating said heating element and determining a maximum temperature of said water during a heating duration of step D or within a maximum of 10 sec after a heating duration of step D, and G calculating a temperature relation between said maximum temperature and said starting temperature of the water, wherein:

said steps A to G are executed in said pump at a beginning of an operation of said pump or at one of first 50 operating cycles of said pump for determining an initial temperature relation, said steps A to G are executed again at a later stage for determining a later temperature relation to determine a heating efficiency of said pump by comparing said later temperature relation to said initial temperature relation, and said water in said pump chamber is heated up to a maximum temperature of no more than 80° C.

2. The method according to claim 1, wherein a predefined amount of water is provided in said pump chamber in step A.

3. The method according to claim 1, wherein said heating element to heat said water in said pump chamber after measuring said temperature of said water is activated for a predefined heating duration in step D.

4. The method according to claim 3, wherein said heating element is deactivated in step F after said predefined heating duration in step D.

5. The method according to claim 1, wherein said temperature relation is a temperature difference such that said starting temperature of said water is subtracted from said maximum temperature of said water, wherein said heating efficiency of said pump is determined to be reduced if said initial temperature difference is larger than said later temperature difference.

6. The method according to claim 5, wherein in case that said later temperature difference is less than 90% of said initial temperature difference, a signal prompting a user to start a de-calcification process of said pump is generated or an automatic de-calcification process of said pump is started.

7. A method for operating a pump with an integrated heating element, wherein said pump comprises: a pump chamber with an inlet into said pump chamber and with an outlet out of said pump chamber and with a wall, a pump rotor inside said pump chamber, a drive motor for said pump rotor, a heating element being provided on at least a part of said wall of said pump chamber, and a temperature sensor for sensing a temperature of water in said pump chamber, the method comprising the steps of:

A providing water in said pump chamber,

B rotating said pump rotor for mixing said water in said pump chamber without transporting water out of said pump chamber, C measuring a temperature of said water in said pump chamber with said temperature sensor as a starting temperature, D activating said heating element to heat said water in said pump chamber after measuring said temperature of said water, E measuring said temperature of said water in said pump chamber with said temperature sensor, F deactivating said heating element and determining a maximum temperature of said water during a heating duration of step D or within a maximum of 10 sec after a heating duration of step D, and G calculating a temperature relation between said maximum temperature and said starting temperature of the water, wherein:

said steps A to G are executed in said pump at a beginning of an operation of said pump or at one of first 50 operating cycles of said pump for determining an initial temperature relation, said steps A to G are executed again at a later stage for determining a later temperature relation to determine a heating efficiency of said pump by comparing said later temperature relation to said initial temperature relation, said temperature relation is a temperature difference such that said starting temperature of said water is subtracted from said maximum temperature of said water, wherein said heating efficiency of said pump is determined to be reduced if said initial, in case that said later temperature difference is less than 90% of said initial temperature difference, a signal prompting a user to start a de-calcification process of said pump is generated or an automatic de-calcification process of said pump is started, and in step B said rotational speed of said pump rotor is less than 500 rpm.

8. The method according to claim 1, wherein when comparing said later temperature relation to said initial temperature relation, said heating efficiency is determined to be reduced if said initial temperature relation is different from said later temperature relation.

9. The method according to claim 1, wherein said steps A to G are repeated consecutively at least two or three times to find a median temperature relation from each of said determined temperature relation.

10. The method according to claim 1, wherein said method is repeated in regular manner.

11. The method according to claim 10, wherein said method is repeated in regular manner at a number of operating cycles of an electrical appliance in which said pump is provided, wherein said number of said operating cycles between each regular repeating is between 5 and 100.

12. The method according to claim 3, wherein said predefined heating duration is between 10 sec and 60 sec.

13. The method according to claim 12, wherein said predefined heating duration is between 20 sec and 30 sec.

14. The method according to claim 1, wherein an operating voltage of said heating element is monitored and a correction factor is adapted to variations of said operating voltage, wherein said correction factor is taken into account when determining said temperature relation.

15. The method according to claim 14, wherein said correction factor is taken into account when determining said temperature relation such that said temperature relation is independent from said operating voltage or its variation, respectively.

16. The method according to claim 14, wherein a drive voltage in a drive circuit for said drive motor corresponds to said operating voltage of said heating element and wherein said drive voltage is measured.

17. The method according to claim 1, wherein said heating element is a PTC heating element with a PTC effect of its resistance behaviour.

18. The method according to claim 1, wherein said temperature sensor is an NTC temperature sensor with an NTC effect of its resistance behaviour.

19. The method according to claim 1, wherein said pump is provided with an axial inlet into said pump chamber.

20. The method according to claim 19, wherein said outlet out of said pump chamber is to a side or parallel to a radial direction of said pump chamber.

21. The method according to claim 1, wherein said water in said pump chamber is heated up to a maximum temperature of no more than 65° C.

22. The method according to claim 7, wherein in step B said rotational speed of said pump rotor is from 10 rpm to 300 rpm.

23. A method for operating a pump with an integrated heating element, wherein said pump comprises: a pump chamber with an inlet into said pump chamber and with an outlet out of said pump chamber and with a wall, a pump rotor inside said pump chamber, a drive motor for said pump rotor, a heating element being provided on at least a part of said wall of said pump chamber, and a temperature sensor for sensing a temperature of water in said pump chamber, the method comprising the steps of:

A providing water in said pump chamber,

B rotating said pump rotor for mixing said water in said pump chamber without transporting water out of said pump chamber, C measuring a temperature of said water in said pump chamber with said temperature sensor as a starting temperature, D activating said heating element to heat said water in said pump chamber after measuring said temperature of said water, E measuring said temperature of said water in said pump chamber with said temperature sensor, F deactivating said heating element and determining a maximum temperature of said water during a heating duration of step D or within a maximum of 10 sec after a heating duration of step D, and G calculating a temperature relation between said maximum temperature and said starting temperature of the water, wherein:

said steps A to G are executed in said pump at a beginning of an operation of said pump or at one of first 50 operating cycles of said pump for determining an initial temperature relation, said steps A to G are executed again at a later stage for determining a later temperature relation to determine a heating efficiency of said pump by comparing said later temperature relation to said initial temperature relation, an operating voltage of said heating element is monitored and a correction factor is adapted to variations of said operating voltage, wherein said correction factor is taken into account when determining said temperature relation, and a drive voltage in a drive circuit for said drive motor corresponds to said operating voltage of said heating element and wherein said drive voltage is measured.

* * * * *